US007970309B2

(12) United States Patent
Sato et al.

(10) Patent No.: US 7,970,309 B2
(45) Date of Patent: Jun. 28, 2011

(54) IMAGE FORMING APPARATUS INCLUDING A POWER-CONTROL FEATURE FOR FLICKER SUPPRESSION

(75) Inventors: Kei Sato, Numazu (JP); Yasuhiro Shimura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/726,653

(22) Filed: Mar. 18, 2010

(65) Prior Publication Data

US 2010/0247131 A1 Sep. 30, 2010

(30) Foreign Application Priority Data

Mar. 30, 2009 (JP) ..... 2009-082645

(51) Int. Cl.
*G03G 15/20* (2006.01)

(52) U.S. Cl. ..... 399/69; 219/216; 399/37

(58) Field of Classification Search ..... 399/69, 399/67, 33, 37; 219/216; 347/156
See application file for complete search history.

(56) References Cited

U.S. PATENT DOCUMENTS

| | | | | |
|---|---|---|---|---|
| 6,853,818 | B2 | 2/2005 | Nishida | |
| 2003/0072581 | A1 | 4/2003 | Nishida | |
| 2010/0239301 | A1 * | 9/2010 | Nemoto et al. | 399/69 |

FOREIGN PATENT DOCUMENTS

| | | |
|---|---|---|
| JP | 5-281865 | 10/1993 |
| JP | 8-036323 A | 2/1996 |
| JP | 2003/123941 A | 4/2003 |
| JP | 2008/209604 A | 9/2008 |

* cited by examiner

*Primary Examiner* — Sophia S Chen
(74) *Attorney, Agent, or Firm* — Fitzpatrick, Cella, Harper & Scinto

(57) ABSTRACT

The image forming apparatus includes an image forming part, a fixing part including a heater and a temperature detection element; and a power-control part that controls power to be supplied to the heater according to the detection temperature of the temperature detection element, wherein during the power to be supplied to the heater is controlled so as to keep the detection temperature at a control target temperature, if the on-duty ratio selected so to keep the detection temperature at the control target temperature is a specific on-duty ratio and the specific on-duty ratio continues for a predetermined number of cycles, the power-control part switches to another control cycle different in the number of consecutive half-waves of the AC waveform from the control cycle.

6 Claims, 10 Drawing Sheets

| FIG. 11A |
| --- |
| FIG. 11B |

IMAGE FORMING APPARATUS INCLUDING A POWER-CONTROL FEATURE FOR FLICKER SUPPRESSION

BACKGROUND OF THE INVENTION

1. Field of the Invention

The present invention relates to an image forming apparatus including a fixing part for heat-fixing a toner image on a recording sheet.

2. Description of the Related Art

Conventionally, a heat roller type heat fixing apparatus using a halogen heater as the heat source thereof or a film heating type heat fixing apparatus using a ceramic heater as the heat source thereof has been used as a fixing apparatus for heating and fixing a toner image in an image forming apparatus, including a copier or a laser beam printer.

In general, a heater is connected to an AC power supply through a switching element, such as a gate-controlled semiconductor switch. Power is supplied to the heater using this AC power supply. A temperature detection element, for example, a thermistor as a temperature-sensitive element is provided in the fixing apparatus and, thereby, the temperature thereof is detected. The switching element is on/off-controlled based on the detected temperature to turn on/off a supply of power to the heater. Thus, the fixing apparatus is temperature-controlled so as to be set to a target temperature. The heater is on/off-controlled by means of phase-control or wavenumber-control.

Phase-control is a method of control in which power is supplied to the heater by turning on the heater at any phase angle within one half-wave of the AC power supply. On the other hand, wavenumber-control is a method of power control in which the heater is turned on/off in units of half-waves of the AC power supply. Conventionally, either the above-described phase-control or wavenumber-control has been used in most cases.

Reasons for selecting phase-control include suppressing blinks, i.e., flickers in lighting equipment. A flicker refers to a phenomenon in which a voltage variation occurs in the AC power supply due to the load current fluctuation of electric equipment connected to the same power supply as that of the lighting equipment and the impedance of distribution lines, thus causing the lighting equipment to flicker. Since a current is turned on in units of half-waves in phase-control, the amount of current change is small and the cycle thereof is short. Consequently, flickers can be prevented from being emitted. On the other hand, in wavenumber-control, on/off-control is performed in units of half-waves of the AC power supply. Accordingly, a current variation becomes larger in wavenumber-control than in phase-control and, therefore, flickers are liable to occur.

Reasons for selecting wavenumber-control include suppressing harmonic currents and switching noise. Harmonic currents and switching noise occur due to a sudden current variation caused when the heater is turned on/off. Wavenumber-control is selected because these harmonic currents and switching noise are less likely to occur in this control, in which the heater is always on/off-controlled at zero-crossing points, than in phase-control in which the heater is switched on/off partway through a half-wave of the AC power supply. These harmonic currents and switching noise tend to be greater in magnitude in proportion to the voltage of an AC power supply used.

Accordingly, the control method of the heater is generally fixed according to an AC commercial power supply voltage in a district where an image forming apparatus is used. For example, a phase-control system advantageous against flickers is adopted for a district using an AC commercial power supply voltage of 100 to 120 V. In contrast, a wavenumber-control system advantageous against harmonic currents and switching noise is adopted for a district using an AC commercial power supply voltage of 220 to 240 V.

However, some literature proposes a system that combines phase-control and wavenumber-control. For example, according to Japanese Patent Application Laid-Open No. 2003-123941, phase-control is performed for some half-waves, among a plurality of half-waves defined as one control cycle, and wavenumber-control is performed for the rest of the half-waves. This system enables the suppression of harmonic currents and switching noise to a greater extent, compared with a system using phase-control alone. In addition, Japanese Patent Application Laid-Open No. 2003-123941 states that flickers can be reduced to a greater extent and power to the heater can be controlled in a greater number of steps, compared with a system using wavenumber-control alone.

Power supplied to a heater is increasing steadily due to a recent increase in printing speed. In addition, it has become increasingly difficult to comply with regulations on flicker and harmonic current emissions by means of conventional heater power control using phase-control or wavenumber-control alone, due to the tightening of such regulations. On the other hand, such a control system that combines phase-control and wavenumber-control as described in Japanese Patent Application Laid-Open No. 2003-123941 is effective.

It is difficult, however, to comply with various regulations and reduce adverse effects on external equipment in every situation where power supplied to a heater increases further and variations are present in a commercial AC power supply voltage, a heater resistance value, and the like, simply by combining phase-control and wavenumber-control.

SUMMARY OF THE INVENTION

The present invention has been accomplished in view of the foregoing problems, and an object thereof is to provide an image forming apparatus including a fixing part capable of reducing flickers.

Another object of the present invention is to provide an image forming apparatus including an image forming part that forms a toner image on a recording sheet, a fixing part that heat-fixes the toner image on the recording sheet, the fixing part including a heater that generates heat by power supplied from a commercial AC power supply and a temperature detection element that detects a temperature of the heater; and a power-control part that controls power to be supplied to the heater according to a detection temperature of the temperature detection element, wherein when power to be supplied to the heater is controlled so as to keep the detection temperature of the temperature detection element at a control target temperature, the power-control part sets an on-duty ratio according to the detection temperature for each of control cycles, each of whose one period is defined as a plurality of consecutive half-waves of an AC waveform, wherein during the power to be supplied to the heater is controlled so as to keep the detection temperature at the control target temperature, if the on-duty ratio selected so as to keep the detection temperature at the control target temperature is a specific on-duty ratio and the specific on-duty ratio continues for a predetermined number of control cycles, the power-control part switches to another control cycle different in the number of consecutive half-waves of the AC waveform from a present control cycle.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Hereinafter, the best modes for carrying out the present invention will be described in detail by referring to exemplary embodiments.

Embodiment 1

Figure 1:
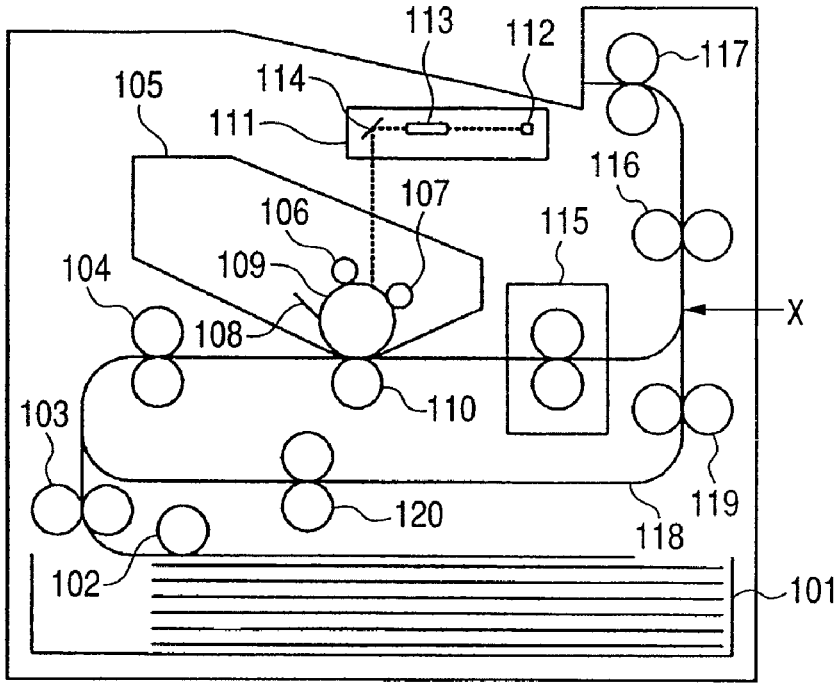
FIG. 1 is a configuration diagram illustrating an image forming apparatus of the present invention.

FIG. 1 illustrates a configuration of an image forming apparatus according to the present invention. Recording sheets loaded on a sheet-feeding cassette 101 are sent out therefrom, one sheet at a time, by a pickup roller 102. The recording sheet is then carried by a sheet-feeding roller 103 toward a registration roller 104. The recording sheet is carried further to a process cartridge 105 by a registration roller 104 at a predetermined timing. The process cartridge 105 integrally configured with a charging unit 106, a development roller 107 provided as a development unit, a cleaner 108 provided as a cleaning unit, and a photosensitive drum 109 provided as an electrophotographic photoreceptor. Thus, an unfixed toner image is formed on the recording sheet by a series of heretofore-known electrophotographic processes.

The photosensitive drum 109, after being uniformly surface-charged by the charging unit 106, is subjected to image exposure based on an image signal by a scanner unit 111 provided as image exposure means. Laser light emitted from a laser diode 112 within the scanner unit 111 is scanned in a main scanning direction through a rotating polygon mirror 113 and a reflecting mirror 114, and is scanned in a sub-scanning direction by the rotation of the photosensitive drum 109. Thus, a two-dimensional latent image is formed on the photosensitive drum. The latent image on the photosensitive drum 109 is visualized by the development roller 107 as a toner image. The toner image is transferred by a transfer roller 110 onto the recording sheet carried from the registration roller 104.

Subsequently, the recording sheet onto which the toner image has been transferred is carried to a fixing apparatus 115, where the recording sheet is heat and pressure-treated and an unfixed toner image on the recording sheet is fixed thereonto. The recording sheet is carried further by an intermediate sheet-discharge roller 116 and a paper delivery roller 117, so as to be ejected out of the main unit of the image forming apparatus. Thus, a series of printing operations is completed.

If double-sided printing is performed, an unillustrated fixing motor rotates in a reverse direction and the intermediate sheet-discharge roller 116 and the paper delivery roller 117 also rotate in the reverse direction when the posterior end of the recording sheet comes out of the fixing apparatus 115 and passes through a point X in the figure. Consequently, the carrying direction of the recording sheet is reversed and the recording sheet is sent into a double-sided sheet conveyance path 118. The recording sheet thus sent into the double-sided sheet conveyance path 118 is once again carried to the registration roller 104 by a double-sided sheet conveyance roller 119 and a sheet-refeeding roller 120. Thus, a second side of the recording sheet is printed according to the same sequence as described above.

Figure 2:
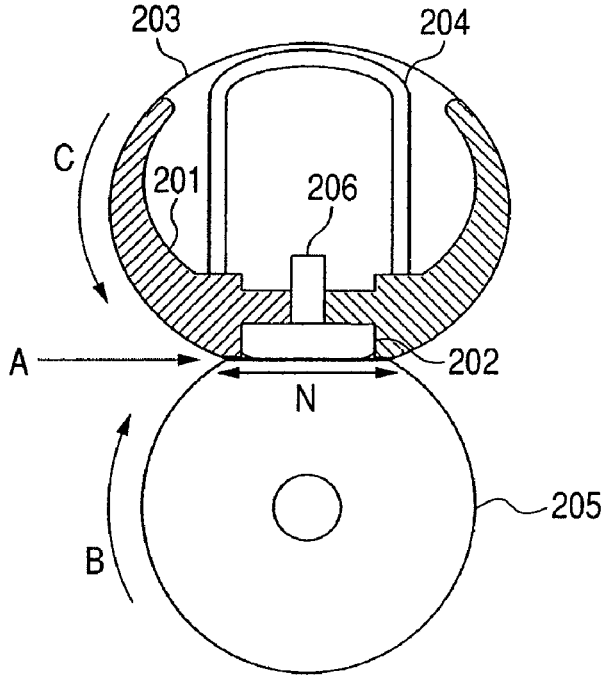
FIG. 2 is a configuration diagram illustrating a fixing apparatus of the present invention.

FIG. 2 is a schematic cross-sectional configuration diagram of the fixing apparatus 115. The fixing apparatus of the present embodiment is a film heating type apparatus using a ceramic heater as the heat source thereof. A heater holder 201 is a heat-resistant adiabatic rigid member for fixing the ceramic heater and guiding a film inner surface. The heater holder 201 is a horizontally-long member the longitudinal direction of which is a direction crossing the carrying path of a recording sheet (a direction perpendicular to the drawing). A ceramic heater 202 is a horizontally-long member the longitudinal direction of which is a direction crossing a transfer material carrying path. The ceramic heater 202 is fitted in a groove formed in the lower surface of the heater holder 201 along the longitudinal direction thereof, and is fixedly supported with a heat-resistant adhesive agent.

A cylindrical heat-resistant film material (hereinafter referred to as a fixing film or an endless belt) 203 is externally and loosely fitted on the heater holder 201 equipped with the ceramic heater 202. A stay 204 is a rigid member the longitudinal direction of which is a direction perpendicular to the drawing, and is disposed inside the heater holder 201. The pressure roller 205 is located so as to sandwich the fixing film 203 along with the ceramic heater 202 of the heater holder 201 and have pressure contact with the fixing film 203. The range denoted by an arrow N is a fixing nip part formed by the pressure contact. The pressure roller 205 is rotary-driven by a fixing motor (not illustrated) at a predetermined circumferential speed in the direction of an arrow B.

The rotational force of the pressure roller 205 directly acts upon the fixing film 203 due to a frictional force between the pressure roller 205 and the circumference of the fixing film 203 in the fixing nip N. Consequently, the fixing film 203 is rotary-driven in the direction of an arrow C, while sliding in pressure contact with the lower surface of the ceramic heater 202. The heater holder 201 functions as an inner surface guide member of the fixing film 203, thereby facilitating the rotation of the fixing film 203. A small amount of lubricant, such as heat-resistant grease, may be additionally applied between the two surfaces, in order to reduce sliding resistance between the inner surface of the fixing film 203 and the lower surface of the ceramic heater 202.

Under the condition that the follow-up rotation of the fixing film 203 by the rotation of the pressure roller 205 has gone into a steady state and the ceramic heater 202 has reached a predetermined temperature, the recording sheet to be fixed is introduced between the fixing film 203 and the fixing nip N based on the pressure roller 205, and is carried while being held therebetween. As a result, the heat of the ceramic heater 202 is transferred to an unfixed image on the recording sheet through the fixing film 203, and the unfixed image on the recording sheet is heat-fixed.

The recording sheet having passed through the fixing nip N is separated from a surface of the fixing film 203 and is carried forward. Note that the arrow A in FIG. 2 denotes a carrying direction of the recording sheet. The fixing apparatus 115 includes a thermistor 206 which is a thermosensor for detecting the temperature of the ceramic heater 202. The thermistor 206 is pressed by a spring or the like against the ceramic heater 202 at a predetermined pressure, in order to detect the temperature of the ceramic heater 202.

Figure 3:
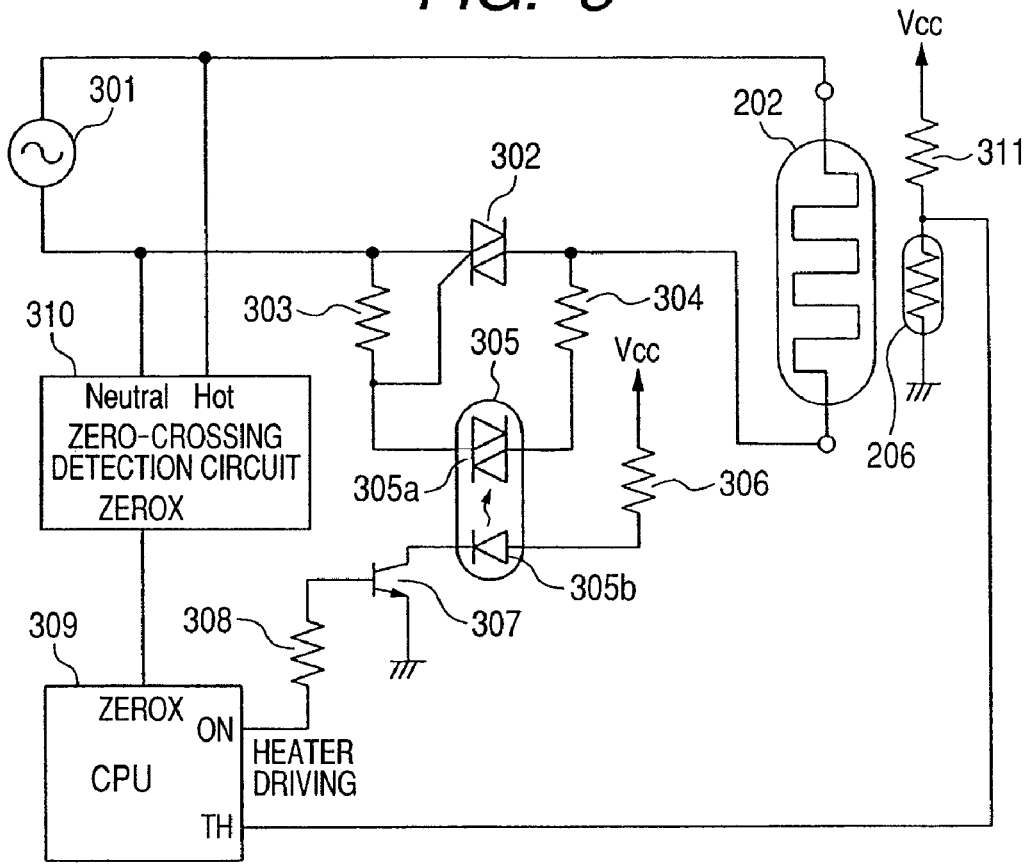
FIG. 3 is a configuration diagram illustrating a heater driving circuit of the fixing apparatus of the present invention.

FIG. 3 illustrates a driving circuit and a control circuit for a heater of the present embodiment. In the figure, a commercial AC power supply 301 is connected to the image forming apparatus. The image forming apparatus causes heat generation by supplying an input voltage from the AC power supply 301 to the heater 202. Power to the heater 202 is supplied by turning on/off a gate-controlled semiconductor switch 302. Resistors 303 and 304 are bias resistors for the gate-controlled semiconductor switch 302. A gate-controlled semiconductor-switch type photocoupler 305 is a device used to secure a creepage distance between primary and secondary stages.

The gate-controlled semiconductor switch 302 is turned on by turning on a current through a light-emitting diode 305*a* of the gate-controlled semiconductor-switch type photocoupler 305. A resistor 306 is used to limit the current of the gate-controlled semiconductor-switch type photocoupler 305. The gate-controlled semiconductor-switch type photocoupler 305 is turned on/off by a transistor 307. The transistor 307 operates according to a heater driving signal sent from a CPU 309 through a resistor 308.

An input power supply voltage from the AC power supply 301 is also supplied to a zero-crossing detection circuit 310 which is a voltage waveform detection unit. The zero-crossing detection circuit 310 detects zero-crossing points of the input power supply voltage to output a zero-crossing signal to the CPU 309.

Figure 4:
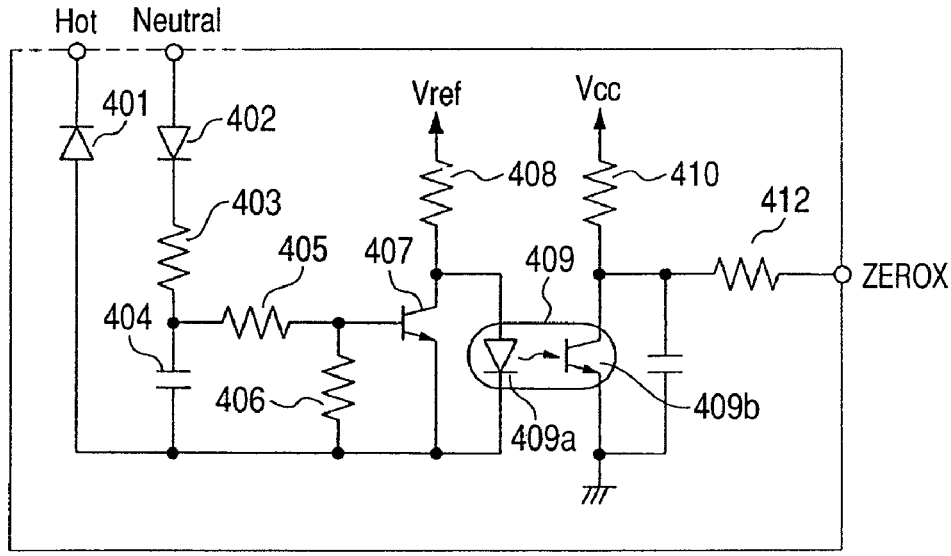
FIG. 4 is a configuration diagram illustrating a zero-crossing circuit of the present invention.

FIG. 4 illustrates details on the zero-crossing detection circuit 310. An AC voltage from the AC power supply 301 is input to the zero-crossing detection circuit 310 of FIG. 4, and is half-wave rectified by rectifiers 401 and 402. In this circuit, a Neutral side is rectified. This half wave-rectified AC voltage is input to the base of a transistor 407 through a resistor 403, a capacitor 404, and resistors 405 and 406. Consequently, if the Neutral-side potential is higher than a Hot-side potential, the transistor 407 turns on and, if the Neutral-side potential is lower than the Hot-side potential, the transistor 407 turns off.

A photocoupler 409 is an element used to secure a creepage distance between primary and secondary stages. Resistors 408 and 410 are used to limit a current flowing through the photocoupler 409. If the Neutral-side potential rises higher than the Hot-side potential, the transistor 407 turns on. Consequently, a light-emitting diode 409*a* within the photocoupler 409 goes off and a phototransistor 409*b* therewithin turns off, thereby causing the output voltage of the photocoupler 409 to go to a High level.

On the other hand, if the Neutral-side potential falls lower than the Hot-side potential, the transistor 407 turns off. Consequently, the light-emitting diode 409*a* within the photocoupler 409 comes on and the phototransistor 409*b* turns on, thereby causing the output voltage of the photocoupler 409 to go to a Low level. This output of the photocoupler 409 is annunciated to the CPU 309 through a resistor 412 as a zero-crossing (ZEROX) signal. The zero-crossing signal is a pulse signal the cycle of which is equal to the frequency of the AC power supply and the level of which varies according to the potential polarity of the AC power supply. The CPU 309 detects the rising and falling edges of this zero-crossing signal and turns on/off the gate-controlled semiconductor switch 302 using these edges as triggers, thereby supplying power to the heater 202.

In FIG. 3, a temperature detecting element 206 is used to detect the temperature of the heater 202. As the temperature detecting element 206, a thermistor thermosensor, for example, is provided in contact with the heater 202. The temperature detected by the thermistor 206 is detected as a voltage divided by the resistor 311 and the thermistor 206. This voltage is input to an A/D port of the CPU 309 as a TH signal. By comparing the temperature of the heater 202 detected using the TH signal with a target temperature (control target temperature) at that time, the CPU 309 on/off-controls the heater 202.

Figure 5:
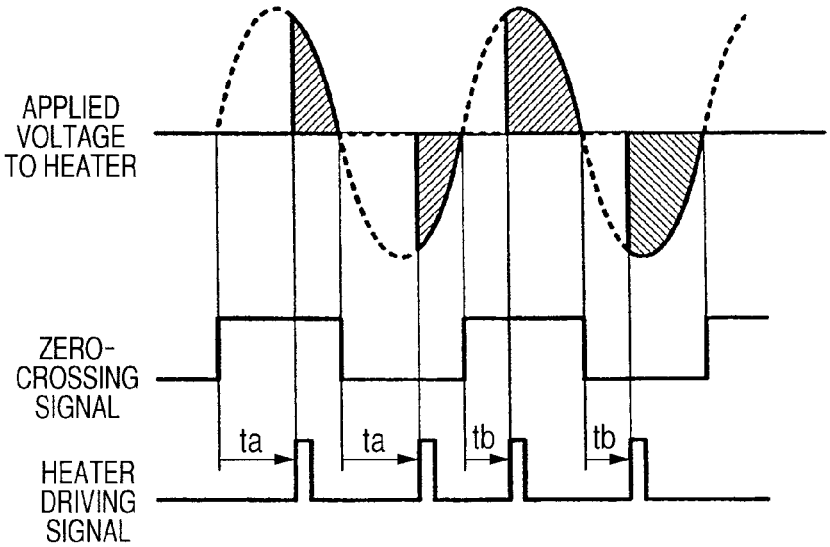
FIG. 5 is an explanatory drawing illustrating phase-control in the present invention.

Next, a description will be given of phase-control and wavenumber-control which are the power control systems of the heater. FIG. 5 illustrates an example of phase-control. A zero-crossing signal changes the logical level thereof at a point in which the AC power supply changes from a positive polarity to a negative polarity, or vice versa. When the zero-crossing signal turns on the heater driving signal a "ta" time later from a rising edge and a falling edge of the zero-crossing signal, the heater turns on and power is supplied thereto at the shaded parts of FIG. 5.

Note that after the heater is turned on, the heater is turned off at the next zero-crossing point. Hence, the heater driving signal is once again turned on a time "ta" later from an edge of the zero-crossing signal to supply the same amount of power to the heater also in the next half-wave. If the heater driving signal is turned on after a lapse of a time "tb", different from the time "ta", the time of conduction to the heater changes. This enables power supplied to the heater to be changed. In this way, a supply of power to the heater is controlled by changing, on a half-wave basis, a period of time during which the heater driving signal is turned on from an edge of the zero-crossing signal. Here, the heater driving signal is assumed to be turned on for the same period of time in consecutive two half-waves.

In phase-control, power to the heater is turned on partway through a half-wave of an AC power supply waveform, as illustrated in FIG. 5. Consequently, a current flowing through the heater rises suddenly, thus causing a harmonic current to flow therethrough. This harmonic current increases as the rising amount of current becomes larger, and is largest at a phase angle of 90°, i.e., at 50% of supply power. In addition, a rising edge of this current arises in every half-wave, thus causing a large amount of harmonic current to flow. Measures for harmonic regulations are therefore essential. For this reason, circuit components, such as filters, are required in many cases. On the other hand, since a current which flows in every half-wave is smaller than a current which flows in one half-wave, the amount of current change is small and the cycle thereof is fast. Thus, the effect of current change on flickers is small.

Figure 6:
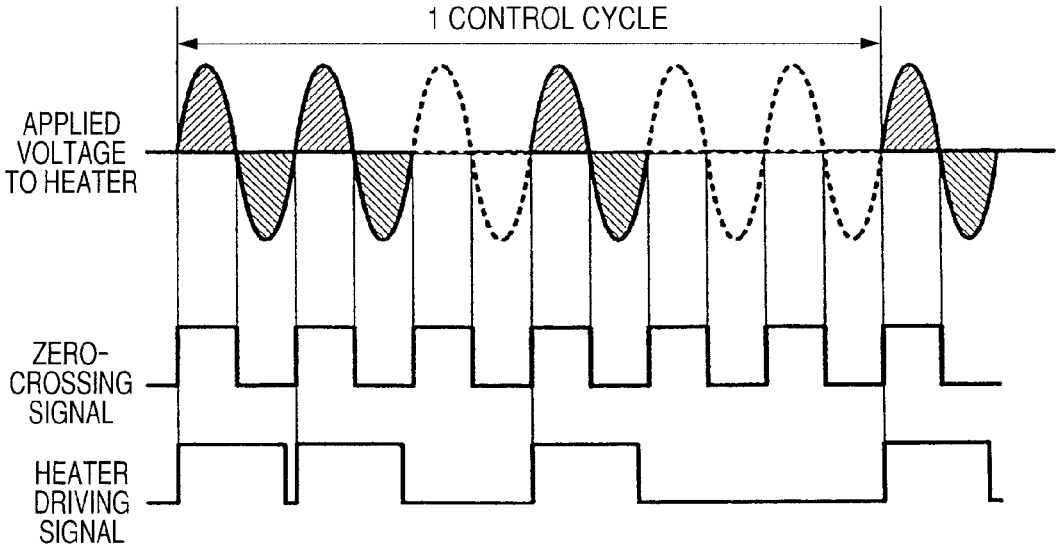
FIG. 6 is an explanatory drawing illustrating wavenumber-control in the present invention.

FIG. 6 illustrates an example of wavenumber-control. In wavenumber-control, on/off-control is performed in units of half-waves of the AC power supply. Accordingly, the heater driving signal is turned on in synchronization with an edge of the zero-crossing signal. For example, 12 half-waves are defined as one cycle of control, and power supplied to the heater is controlled by varying the number of half-waves, within one control cycle, in which the heater driving signal is turned on. In FIG. 6, the heater driving signal is turned on for six half-waves, among the 12 half-waves. Thus, a ratio of power supplied to the heater is 50%. Here, the heater driving signal is assumed to be turned on in consecutive two half-waves.

In wavenumber-control, the heater is always turned on/off at zero-crossing points and is, therefore, free from such a sudden rising edge of current as in phase-control. Thus, the amount of harmonic currents is extremely small. On the other hand, a current flows on a half-wave basis and, therefore, the amount of current change is large and the cycle thereof is long. Thus, the effect of current change on flickers is large. Hence, the effect of a cycle of current variation on flickers is reduced as much as possible by making a contrivance in the position of each half-wave (control pattern) in which the heater driving signal turns on within one control cycle.

In the present embodiment, a plurality of half-waves of the AC power supply is defined as one control cycle, as in wavenumber-control. Control is performed so that phase-control is applied to some of the half-waves and wavenumber-control is applied to the rest of the half-waves. Since particularly phase-control is not performed in every half-wave in such a control system as described above, harmonic currents which may otherwise flow can be reduced.

On the other hand, supply power can be controlled in a multistep manner by means of phase-control even if a control cycle is short. Accordingly, the control cycle can be made shorter, compared with usual wavenumber-control, and the cycle of current variation therefore shortens. Thus, flickers can be reduced easily. With control cycle alone, however, it is difficult to reduce flickers in every current variation due to variations in an AC power supply voltage and a heater resistance value. Hence, the image forming apparatus of the present embodiment has a plurality of control cycles, so as to be able to reduce flickers no matter what type of variation is present, by switching a control cycle during printing.

Figure 7:
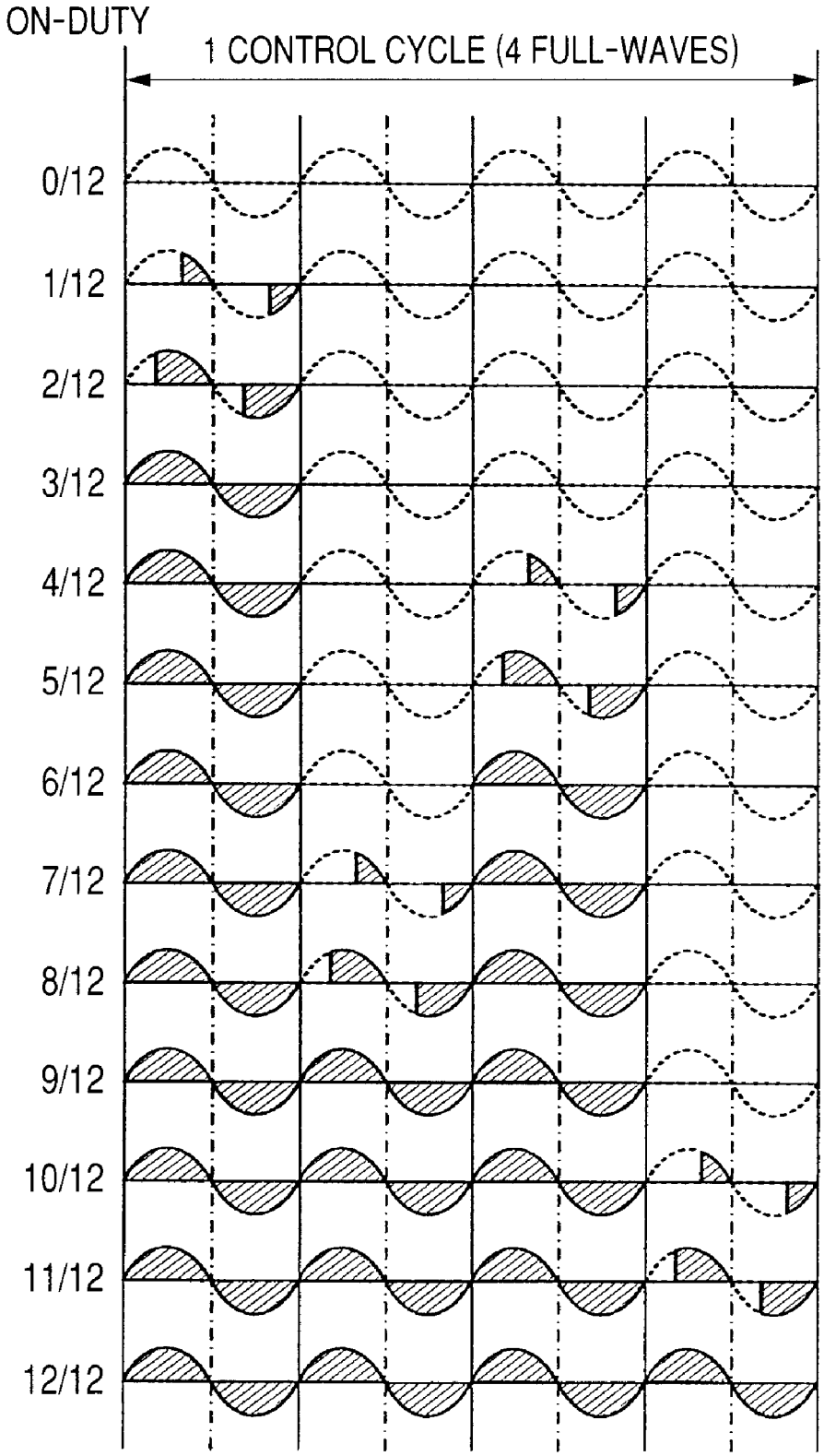
FIG. 7 is a first control pattern of heater power control in the present invention.
Figure 8:
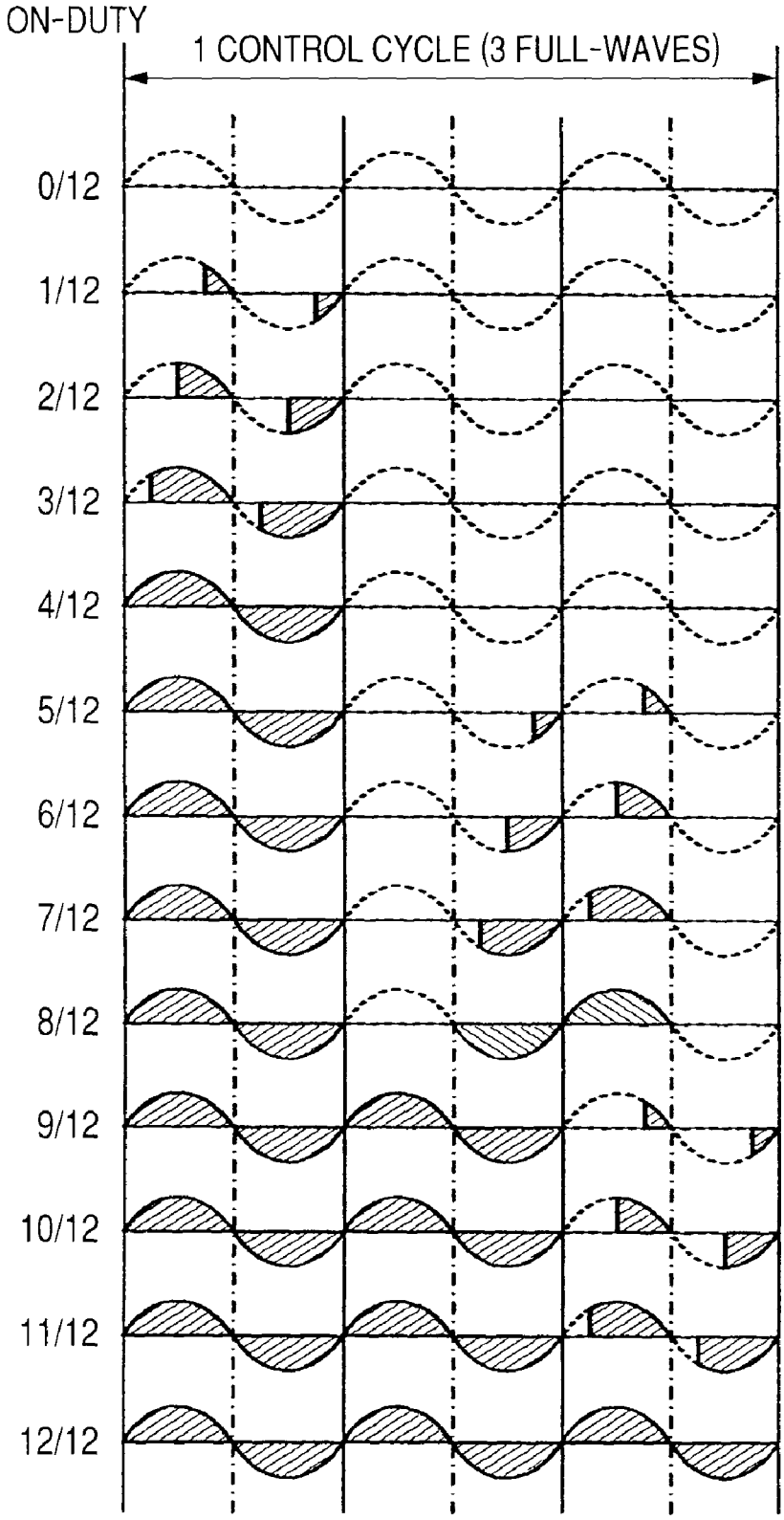
FIG. 8 is a second control pattern of heater power control in the present invention.

FIGS. 7 and 8 illustrate control pattern examples of heater power control in the present embodiment. In the control pattern of FIG. 7, four full-waves (=eight half-waves) are specified as one control cycle, three full-waves thereamong are subjected to wavenumber-control, and one full-wave is subjected to phase-control. A heater supply power of 0% to 100% is divided into 12 steps and a position for the heater to be turned on (control pattern) is specified for each step. Assume here that adjacent positive and negative half-waves satisfy requirements for vertical symmetry in which the heater turns on for the same period of time.

For example, if an on-duty ratio is 1/12 (=8.3%) in FIG. 7, first two half-waves are subjected to phase-control and the heater driving signal is turned on for 33.3% of the entire half-wave in each of the two half-waves. The heater driving signal is turned off for all of the subsequent three wavenumber-controlled full-waves. Thus, a power of approximately 8.3% is supplied in one control cycle. In the case of the next on-duty ratio of 2/12 (=16.7%), first two half-waves are subjected to phase-control and the heater driving signal is turned on for 66.7% of the entire half-wave in each of the two half-waves. The heater driving signal is turned off for all of the subsequent three wavenumber-controlled full-waves. Thus, a power of approximately 16.7% is supplied in one control cycle.

In the case of an on-duty ratio of 3/12, the heater driving signal is turned on for the entire first one full-wave and turned off for all of the remaining three full-waves. Thus, a power of 25% is supplied. In this way, 13-step control patterns including up to an on-duty ratio of 12/12, at which supply power amounts to 100%, are defined as illustrated in FIG. 7.

On the other hand, in FIG. 8, three full-waves (=six half-waves) are specified as one control cycle. Among the three full-waves, two full-waves are subjected to wavenumber-control and one full-wave is subjected to phase-control. As in FIG. 7, a supply power of 0% to 100% is divided into 12 steps and a control pattern is defined in each step. Note that although in the present embodiment, the image forming apparatus has two types of control cycles, the apparatus may have more than two types of control cycles.

Figure 9:
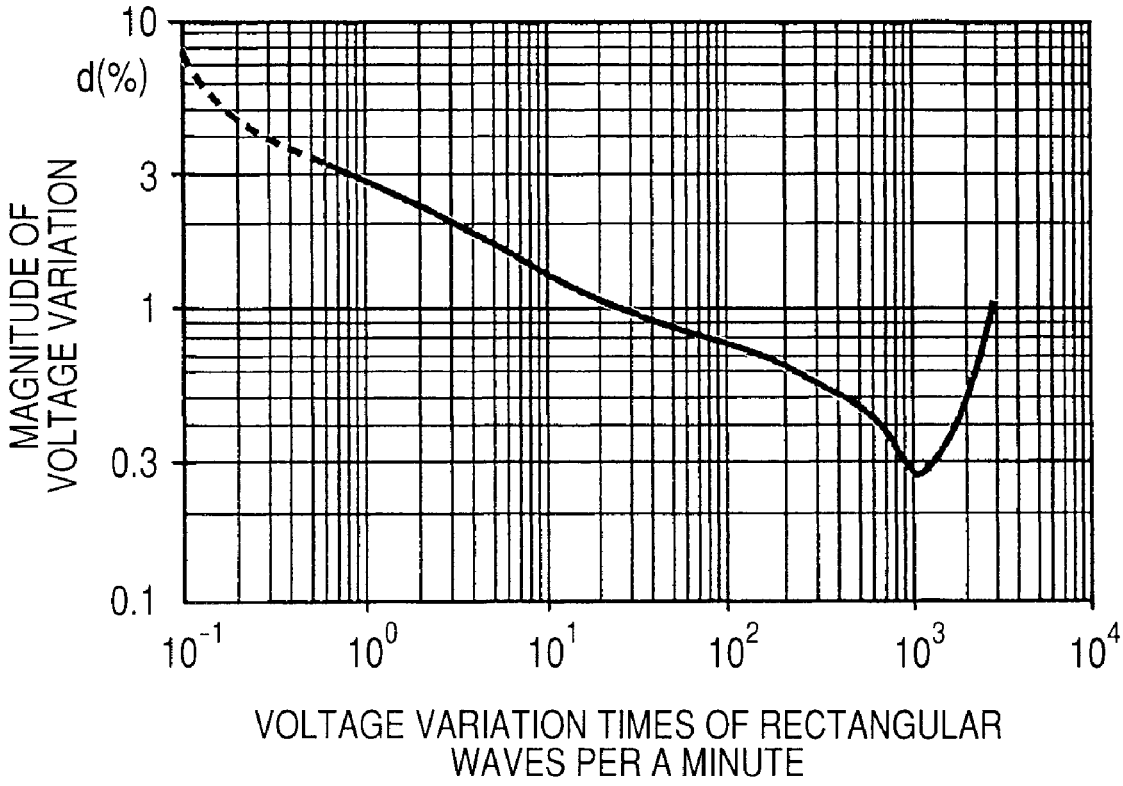
FIG. 9 is a graph illustrating a degree of effect of a voltage variation on flickers.

As described earlier, flickers are blinks in lighting equipment that humans sense and, therefore, reflect human visibility characteristics. FIG. 9 is a graph representing a boundary line which has been prescribed by International Electro-technical Commission (IEC) and on and beyond which a human senses flickers as being offensive. The horizontal axis denotes the number of per minute of rectangular wave-shaped voltage variation. For example, 1200 times of voltage variation, if converted into a frequency component of voltage variation, correspond to 10 Hz. The vertical axis denotes the magnitude of voltage variation when a rated voltage is specified as 100%. Smaller values of this axis indicate that a more significant adverse effect is exerted on flickers at low magnitudes of voltage variation.

That is, an adverse effect on flickers is largest at 900 to 1200 times of voltage variation (frequency of 7.5 to 10 Hz). For example, a voltage variation frequency of 600 to 1800 times per minute (voltage variation frequency of 5 to 15 Hz) means that the amount of voltage variation simply equals 0.4%, thus failing to satisfy flicker standards. Hence, in general, means for reducing adverse effects on flickers is to minimize the possibility of causing voltage variations in this frequency band.

For example, in the case of the control pattern of FIG. 7 one control cycle of which includes four full-waves, an on-duty ratio of 3/12 represents a pattern in which the heater driving signal is turned on for one full-wave and turned off for three full-waves. As a result, Fourier-transforming a current variation in a case where the frequency of an AC power supply is 50 Hz gives the largest frequency component of 12.5 Hz. Thus, the control pattern proves disadvantageous for flicker suppression. Likewise, an on-duty ratio of 9/12 is defined as a pattern in which the heater driving signal is turned on for three full-waves and turned off for one full-wave. Consequently, a major frequency component of current variation is 12.5 Hz. Thus, the control pattern is also disadvantageous for flicker suppression.

An on-duty ratio of 6/12 represents a pattern in which the heater driving signal is turned on for one full-wave apart. Consequently, the frequency component of a current variation is 25 Hz. Thus, this pattern has less adverse effect on flicker suppression. As described above, there are control patterns disadvantageous for flicker suppression, even if the patterns have the same control cycle. On the other hand, in the case of the control pattern of FIG. 8 one control cycle of which includes three full-waves, an on-duty ratio of 3/12, the same as described above, is defined so that the frequency component of current variation is 16.7 Hz. Consequently, this control pattern has less adverse effect on flicker suppression, compared with the control pattern of FIG. 7 in which four full-waves are specified as one control cycle.

As described above, the degree of effect on flickers differs depending on a control cycle, even if on-duty ratios are the same. Hence, in the present embodiment, control is performed so that, if a control pattern being used is disadvantageous for flicker suppression, a switch is made to another control pattern having the same on-duty ratio but a different control cycle.

Comparison in flicker suppression between the control pattern of FIG. 7 one control cycle of which is specified as four full-waves and the control pattern of FIG. 8 one control cycle of which is specified as three full-waves, shows that a three-full-wave cycle is superior when on-duty ratios are 1/12 to 3/12 and 8/12 to 11/12, but a four-full-wave cycle is superior when on-duty ratios are 4/12 to 7/12. Accordingly, when an on-duty ratio used at the time of printing (at the time of fixing processing in which a recording sheet is present at a fixing nip part) is one of 1/12 to 3/12 or 8/12 to 11/12, control is performed at a three-full-wave cycle. In contrast, when the on-duty ratio is one of 4/12 to 7/12, control is performed at a four-full-wave cycle. This enables control to be always performed with an adverse effect on flicker suppression reduced. Note that in normal printing, an on-duty ratio of 50%, i.e., an on-duty ratio of around 6/12 is used in many cases. Hence, control is initially performed using a four-full-wave cycle advantageous for flicker suppression, and then control cycles are switched depending on the on-duty ratio being used. That is, an on-duty ratio selected so that a detection temperature remains at a control target temperature in a cycle (fixing processing cycle), in which a power-control part is controlling power to the heater so that the detection temperature of a temperature detection element remains at the control target temperature, is a specific on-duty ratio and, if the specific on-duty ratio continues for a predetermined number of cycles, the power-control part switches to another control cycle different in the "consecutive number of half-waves of an AC waveform" from the present control cycle. The specific on-duty ratio refers to an on-duty ratio at which a voltage variation frequency equals 5 to 15 Hz. If the frequency of an AC power supply is 50 Hz, on-duty ratios of 1/12 to 3/12 and 8/12 to 11/12 in a four-full-wave cycle and on-duty ratios of 4/12 to 7/12 in a three-full-wave cycle correspond to the specific on-duty ratio.

Figure 10:
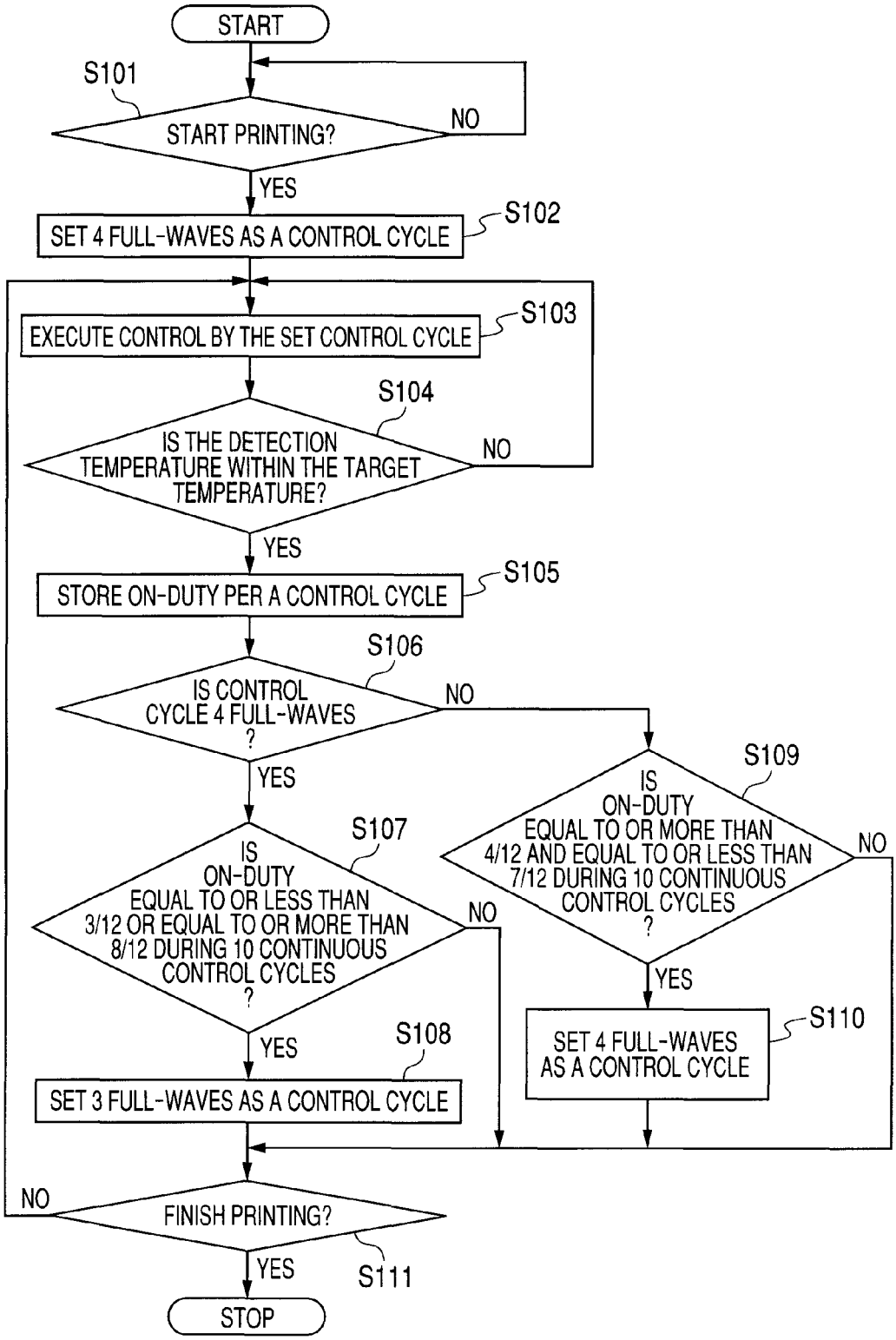
FIG. 10 is a flowchart of control in embodiment 1.

FIG. 10 illustrates a flowchart of control in the present embodiment. After the start of printing (S101), a control cycle is set to four full-waves (S102), and heater power control is started (S103). When a temperature detected with a thermistor falls within a given range of a target temperature (reaches the target temperature) (S104), on-duty ratios used are stored for each control cycle (S105). If the control cycle at that time is a four-full-wave cycle (S106), then a determination is made as to whether the values of the stored on-duty ratios are 3/12 or less or 8/12 or greater for 10 control cycles in a row (S107).

If YES, then the control cycle is switched to three full-waves advantageous for flicker suppression in that range (S108). If NO, then the control cycle is left set to four full-waves. On the other hand, if the control cycle is not four full-waves (but three full-waves), then a determination is made as to whether the value of the stored on-duty ratios are 4/12 or greater but not greater than 7/12 for 10 control cycles (a given period of time) in a row (S109). If YES, then the control cycle is switched to four full-waves (S110). If NO, then the control cycle is left set to three full-waves. In this way, control for switching control cycles is repeatedly performed by going back to step S103, until printing ends, and is completed when printing ends (S111).

As described above, the image forming apparatus has a plurality of control cycles and, if other control cycles are more advantageous for flicker suppression in an on-duty ratio actually used at the time of printing, the apparatus switches control cycles to perform heater power control. As a result, it is possible to perform control with an adverse effect on flicker suppression, irrespective of variations in an AC power supply voltage, a heater resistance value, and the like.

Note that although two types of control cycles, i.e., four full-waves and three full-waves are used here, the control cycles are not limited to these types. Alternatively, the control cycles may be different in length or may be of three or more types. Furthermore, control patterns are not limited to those described above, either. Likewise, on-duty ratios are not limited to those described above, either, since the values of on-duty ratios to be switched vary according to the control patterns.

Embodiment 2

A configuration of an image forming apparatus and heater power control in the present embodiment are the same as in the above-described embodiment 1 and, therefore, the description thereof will not be given here. In the case of a double-sided printable image forming apparatus, printing on a first side is the same as single-sided printing. However, since printing is performed on a second side of a recording sheet warmed by a fixing unit when the first side is printed, an amount of heater supply power required for the second side is smaller than that required for the first side. This means that first-side printing and second-side printing differ from each other in an on-duty ratio to be used.

Hence, in the present embodiment, first-side printing and second-side printing are made independent of each other in terms of control cycle switching control, thereby performing heater power control using the optimum control cycle for each side to improve flicker suppression.

Figures 11, 11A:
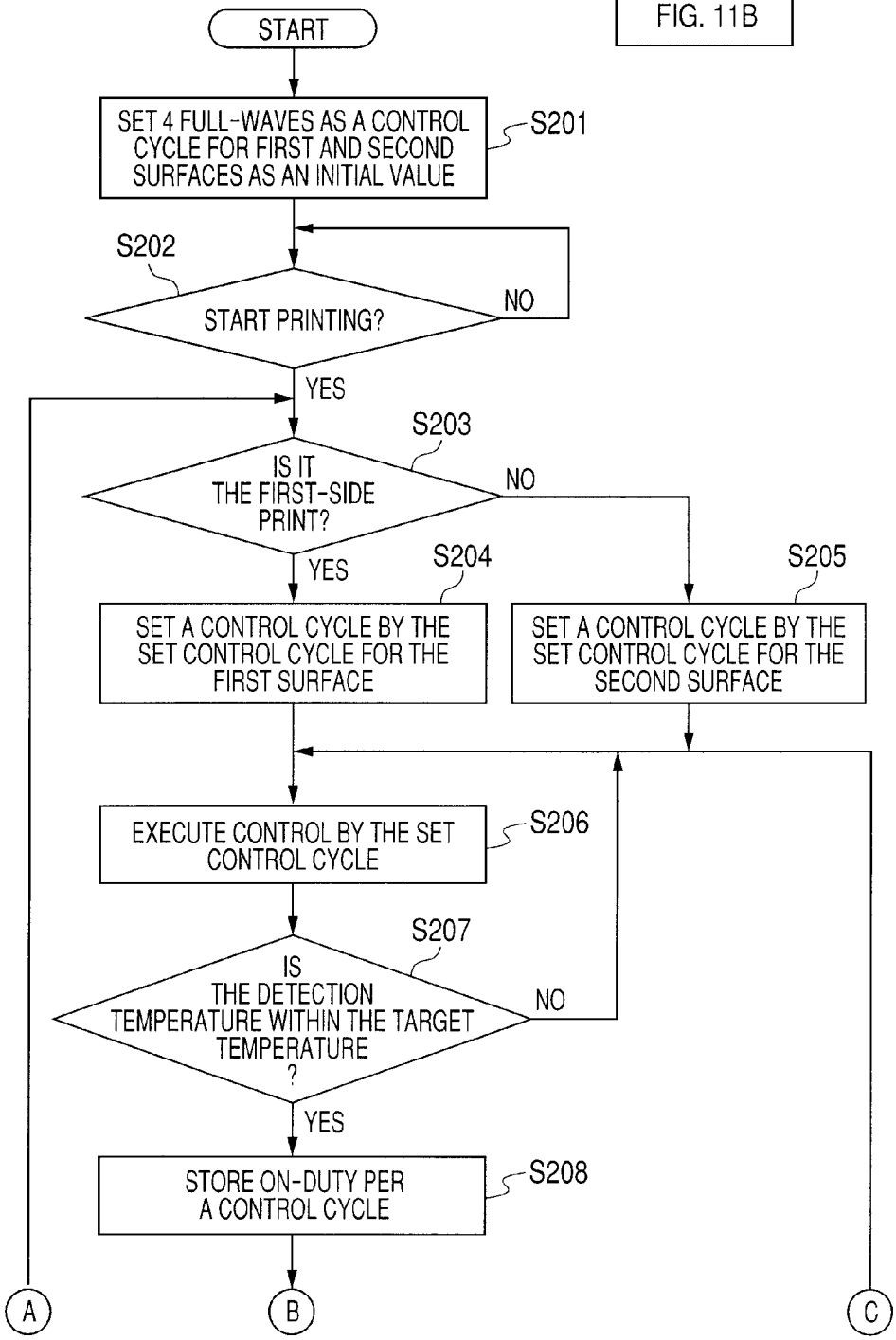
FIG. 11 is comprised of FIGS. 11A and 11B showing flowcharts of control in embodiment 2.
Figure 11B:
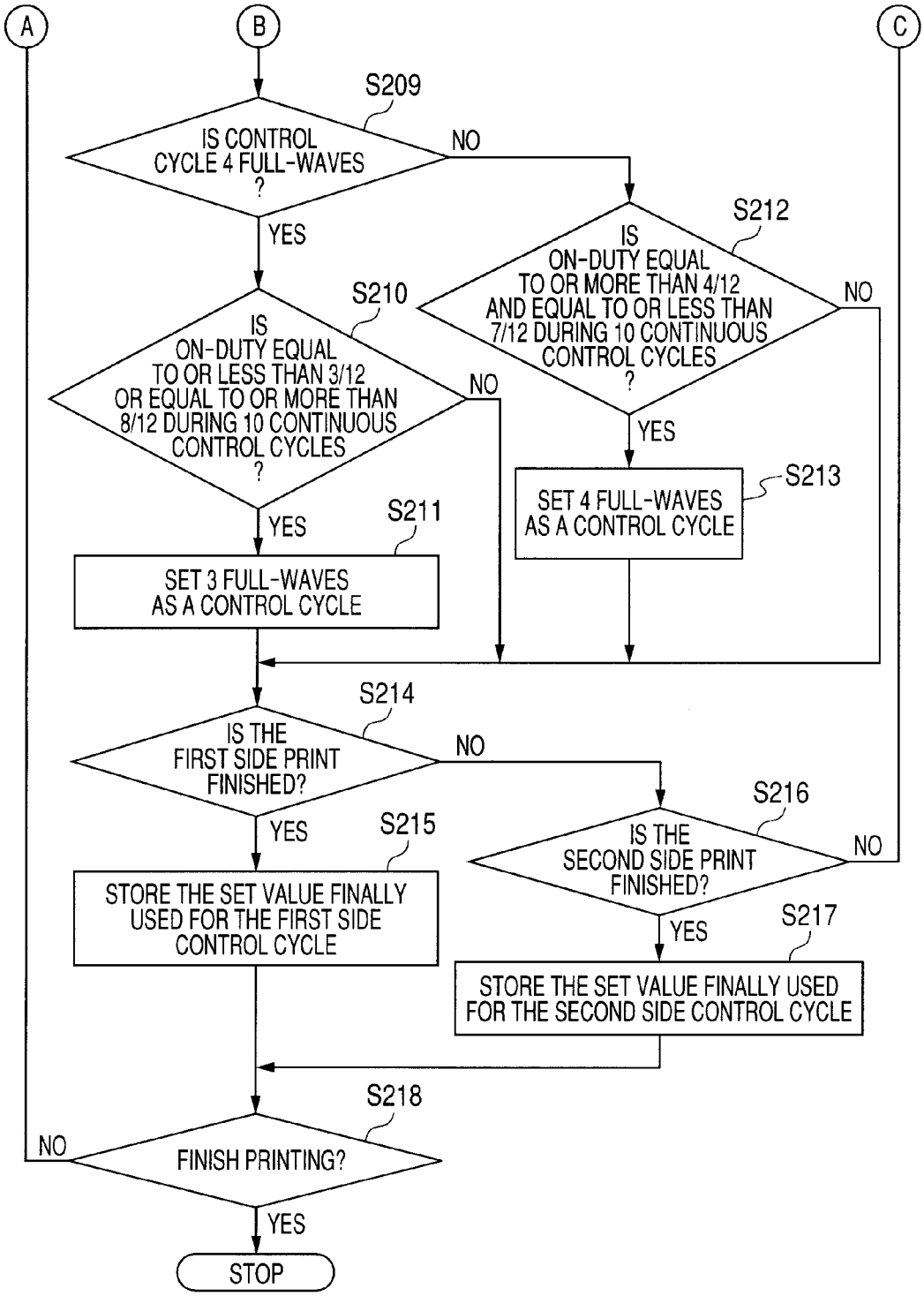

FIGS. 11A and 11B illustrate flowcharts of control in the present embodiment. At the start of printing, both a first side and a second side are set to a control cycle of four full-waves (S201). After the start of printing (S202), if first-side printing is to be performed (S203), a control cycle stored for the first side is set (four full-waves, if the first side is that of a first recording sheet) (S204), and heater power control is started (S206). As in the above-described embodiment 1, control cycle switching control is performed (S206 to S213) and, when first-side printing is completed (S214), the control cycle used at that time is stored as one for first-side printing (S215). Next, a determination is made if printing is finished (S218). If NO, the flow returns to (S203). If YES, the flow stops.

Next, when the second side is printed, a control cycle stored for second-side printing is used (S205), and heater power control is started (S206). Then, as with the first side, control cycle switching control is performed (S206 to S213) and, when second-side printing is completed (S216), the control cycle used at that time is stored as one for second-side printing (S217). Next, a determination is made if printing is finished (S218). If NO, the flow returns to (S203). If YES, the flow stops.

When a first side of the next recording sheet is printed, control once again goes back to step S203, a switch is made to the control cycle for first-side printing stored in the previous step S215 (S204), and heater power control is performed (S206). Likewise, when the second side is printed, a switch is made to the control cycle for second-side printing stored in step (S217) in the second-side printing of the previous recording sheet (S205), and heater control is performed (S206).

In this way, by making the first side and the second side independent of each other in terms of control cycle switching control at the time of double-sided printing, it is possible to promptly switch to respective control cycles more advantageous for flicker suppression, even if amounts of supply power required for the respective sides differ.

Embodiment 3

A configuration of an image forming apparatus and heater power control in the present embodiment is the same as in the above-described embodiment 1 and, therefore, the description thereof will not be given here. If the types of AC power supply voltage, heater, and recording sheet are the same, heater supply power required at the time of printing is almost constant and, therefore, on-duty ratios to be used are also almost constant.

Hence, in the present embodiment, control cycles used in the previous time of printing are stored. At the next time of printing, the control cycles used at the previous time of printing are used to start printing, thereby performing heater power control more advantageous for flicker suppression as early as possible from the start of printing.

Figure 12:
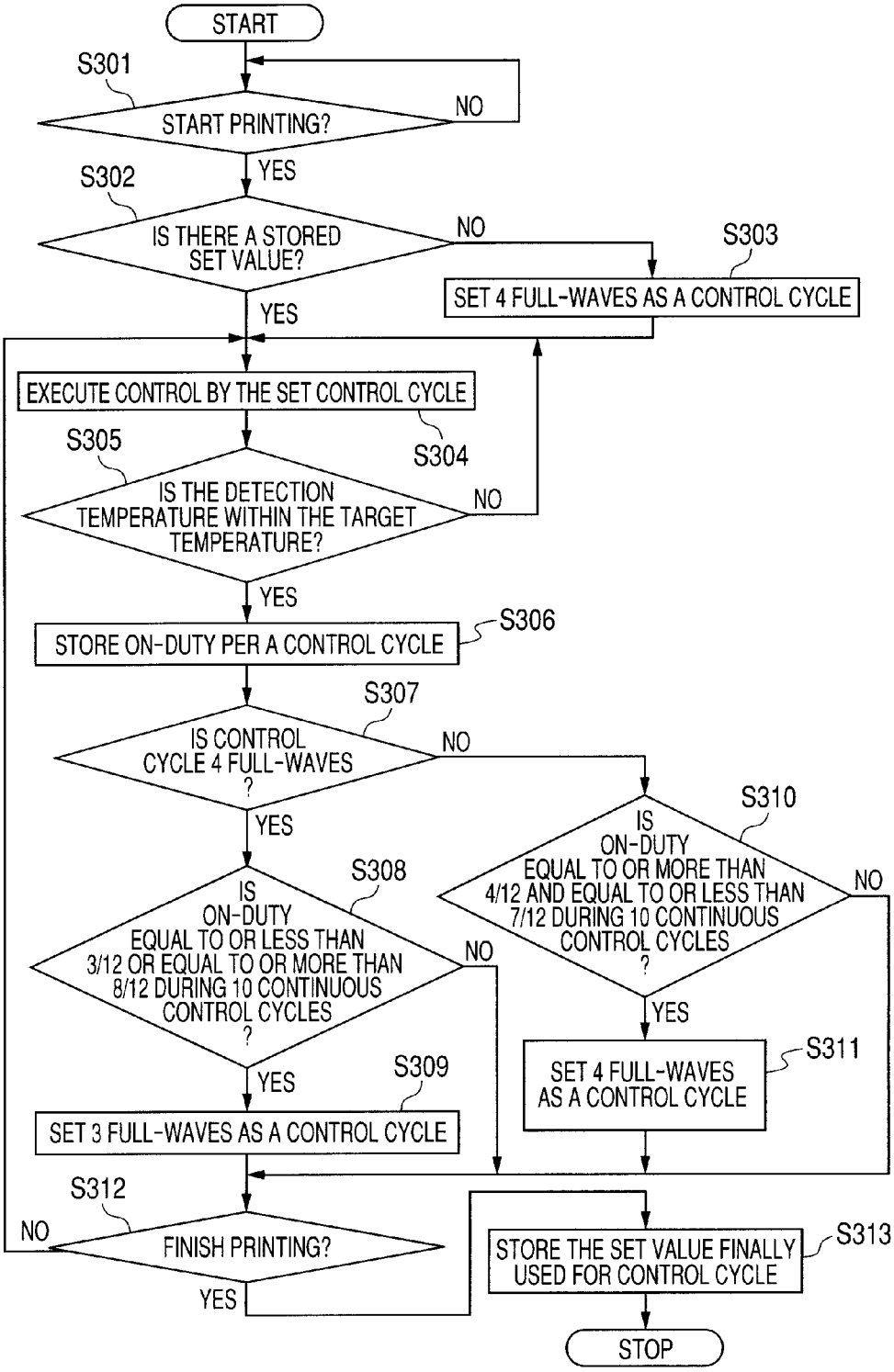
FIG. 12 is a flowchart of control in embodiment 3.

FIG. 12 illustrates a flowchart of control in the present embodiment. After the start of printing (S301), a determination is made as to whether control cycles used at the previous time of printing are stored (S302). If NO, then this is the first time of printing after the power-on of the image forming apparatus and, therefore, a control cycle is set to four full-waves (S303). If the values of previous control cycles are stored (S302), then heater power control is performed using control cycles having those values (S304).

Thereafter, control cycles are switched according to on-duty ratios, from steps S304 up to S311, in the same way as in the above-described embodiment 1. When printing ends (S312), control cycles used at that time are stored (S313). Then, at the next time of printing, control is started using the control cycles used in step 304 in the previous time of printing.

As described above, by using control cycles used at the previous time of printing when printing is started next time, it is possible to perform heater power control more advantageous for flicker suppression as early as possible from the start of printing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-082645, filed on Mar. 30, 2009, which is hereby incorporated by reference herein in its entirety.

What is claimed is:

1. An image forming apparatus comprising:

an image forming part that forms a toner image on a recording sheet;

a fixing part that heat-fixes the toner image on the recording sheet, said fixing part including a heater that generates heat using power supplied from a commercial AC power supply and a temperature detection element that detects a temperature of the heater; and a power-control part that controls power to be supplied to the heater according to a detection temperature of the temperature detection element, wherein when power to be supplied to the heater is controlled so as to keep the detection temperature of the temperature detection element at a control target temperature, said power-control part sets an on-duty ratio according to the detection temperature for each control cycle, each of whose one period is defined as a plurality of consecutive half-waves of an AC waveform, and wherein when power to be supplied to the heater is controlled so as to keep the detection temperature at the control target temperature, if the on-duty ratio selected so as to keep the detection temperature at the control target temperature is a specific on-duty ratio and the specific on-duty ratio continues for a predetermined number of control cycles, the power-control part switches to another control cycle different in the number of consecutive half-waves of the AC waveform from a present control cycle.

2. An image forming apparatus according to claim 1, wherein said power-control part performs phase-control for some half-waves within one of the control cycles and performs wavenumber-control for the other half-waves.

3. An image forming apparatus according to claim 1, further comprising:

a mechanism that forms the toner image on each side of the recording sheet; and a storage unit that stores a control cycle used when the toner image formed on a first side of the recording sheet is fixing-processed and a control cycle used when the toner image formed on a second side of the recording sheet is fixing-processed.

4. An image forming apparatus according to claim 1, further comprising a storage unit that stores a control cycle used when the toner image formed on a recording sheet is fixing-processed, wherein the power-control part uses the control cycle stored in the storage part to set an initial control cycle to be used at the time of current fixing processing.

5. An image forming apparatus according to claim 1, wherein the specific on-duty ratio is an on-duty ratio at which a voltage variation frequency ranges within 5 to 15 Hz.

6. An image forming apparatus according to claim 1, wherein the fixing part further includes:

an endless belt with the inner surface of which the heater has contact; and a pressure roller that forms a fixing nip part whereby the recording sheet is fixing-processed through the endless belt along with the heater.

* * * * *